US009056390B2

(12) United States Patent
Hellström

(10) Patent No.: US 9,056,390 B2
(45) Date of Patent: Jun. 16, 2015

(54) REACTION BAR LOCK NUT

(75) Inventor: Tore Gunnar Hellström, Enebyberg (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 286 days.

(21) Appl. No.: 13/809,658

(22) PCT Filed: Jun. 29, 2011

(86) PCT No.: PCT/EP2011/060964
§ 371 (c)(1),
(2), (4) Date: Jan. 11, 2013

(87) PCT Pub. No.: WO2012/007281
PCT Pub. Date: Jan. 19, 2012

(65) Prior Publication Data

US 2013/0104702 A1 May 2, 2013

(30) Foreign Application Priority Data

Jul. 14, 2010 (SE) ..... 1050788

(51) Int. Cl.
*B25B 23/00* (2006.01)
*B25B 21/00* (2006.01)

(52) U.S. Cl.
CPC ..... *B25B 23/0007* (2013.01); *B25B 21/00* (2013.01); *B25B 23/0078* (2013.01)

(58) Field of Classification Search
CPC .. B25B 21/00; B25B 21/002; B25B 23/0078; B25B 23/0007
USPC ..... 81/54, 55, 57.11, 57.14
See application file for complete search history.

(56) References Cited

U.S. PATENT DOCUMENTS

| | | | | |
|---|---|---|---|---|
| 1,231,840 | A * | 7/1917 | Bolt | 411/140 |
| 4,462,282 | A | 7/1984 | Biek | |
| 4,485,698 | A * | 12/1984 | Adman et al. | 81/57.11 |
| 7,832,310 | B2 * | 11/2010 | Junkers | 81/54 |
| 2003/0136229 | A1 | 7/2003 | Junkers | |

FOREIGN PATENT DOCUMENTS

| | | | |
|---|---|---|---|
| DE | 102 36 586 | A1 | 2/2004 |
| DE | 203 01 759 | U1 | 6/2004 |
| EP | 1 329 293 | A2 | 7/2003 |

OTHER PUBLICATIONS

International Search Report dated Sep. 1, 2011 (in English) in counterpart International Application No. PCT/EP2011/060964.

* cited by examiner

*Primary Examiner* — Hadi Shakeri
(74) *Attorney, Agent, or Firm* — Holtz, Holtz, Goodman & Chick PC

(57) ABSTRACT

A power wrench has a housing with a forwardly extending tubular neck portion, a rotation motor, an output shaft extending coaxially through the neck portion, and a torque reaction bar supported on the neck portion via a splines coupling. The reaction bar is axially locked to the housing by a nut assembly co-operating with a threaded section of the neck portion. The nut assembly includes a nut element, a maneuver ring supported on the nut element, and lock pins extend through axial bores in the nut element and are arranged to positively engage the keyways of the splines coupling in a lock position to rotationally lock the nut assembly relative to the housing. The lock pins are secured to the ring, and a spring is arranged between the nut element and the ring to bias the ring and the lock pins towards the lock position.

4 Claims, 3 Drawing Sheets

REACTION BAR LOCK NUT

This application is a U.S. National Phase Application under 35 USC 371 of International Application PCT/EP2011/060964 filed Jun. 29, 2011.

BACKGROUND OF THE INVENTION

The invention relates to a power wrench comprising a housing with a forwardly extending tubular neck portion, a rotation motor, an output shaft extending coaxially through the neck portion and adapted to be connected to a screw joint, and a torque reaction bar supported on the neck portion via a splines coupling, and a nut engaging a threaded front section of the neck portion for axially clamping the reaction bar to the housing.

In a power wrench of this type the torque reaction bar is supported on the wrench housing via splines coupling which enables mounting of the torque reaction bar in a number of alternative angular positions relative to the housing. In each position the torque reaction bar is locked against rotational movements relative to the housing, but a nut is employed to apply an axial clamping force on the reaction bar against the wrench housing or at least prevent the reaction bar from moving relative to the wrench housing.

It is important, however, that the torque reaction bar is maintained in a proper torque transferring engagement with a stationary object during screw joint tightening operations, because if the reaction bar suddenly should loose that engagement the reaction bar and perhaps the entire power wrench might be thrown off the screw joint in an uncontrolled way, which would be very dangerous for the operator, and human injuries and damage to equipment and the object being worked may be caused. Therefore, it is important that the reaction bar is at least rigidly secured to the power wrench housing to minimize the risks for accidents.

In a power wrench of the above described type where a clamping nut is used for maintaining the reaction bar secured to the wrench housing it is important to provide a lock means to prevent the nut from loosen unintentionally. Accordingly, it is an object of the invention to increase the safety properties of a power wrench by providing the clamping nut assembly with a lock means for avoiding unintentional loosening of the nut assembly.

It is another object of the invention to provide a power wrench with a reaction bar clamping nut assembly having a manually operable lock means conveniently shiftable between a lock position and a release position.

It is a further object of the invention to provide a power wrench with a torque reaction bar supported on a front end splines coupling and clamped to the wrench housing by a nut assembly, wherein the nut assembly comprises a lock means that does not require any special design features on the power wrench housing.

Further objects and advantages of the invention will appear from the following specification and claims.

A preferred embodiment of the invention is described below in detail with reference to the accompanying drawings.

DETAILED DESCRIPTION OF THE PREFERRED EMBODIMENT

Figure 1:
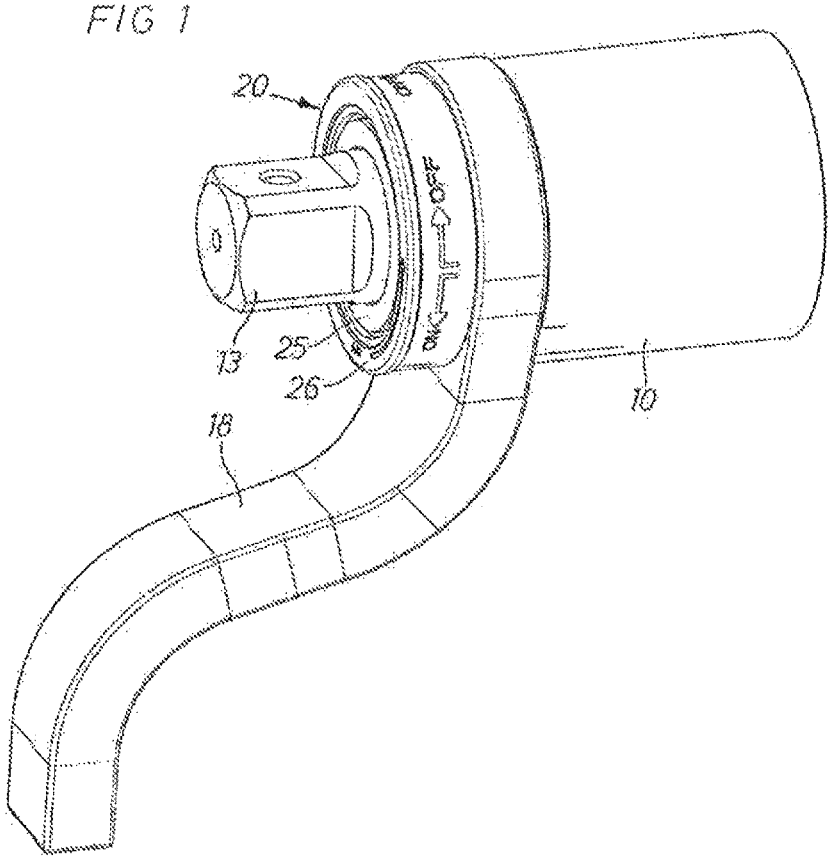
FIG. 1 shows a perspective view of the front part of a power wrench according to the invention.
Figure 2:
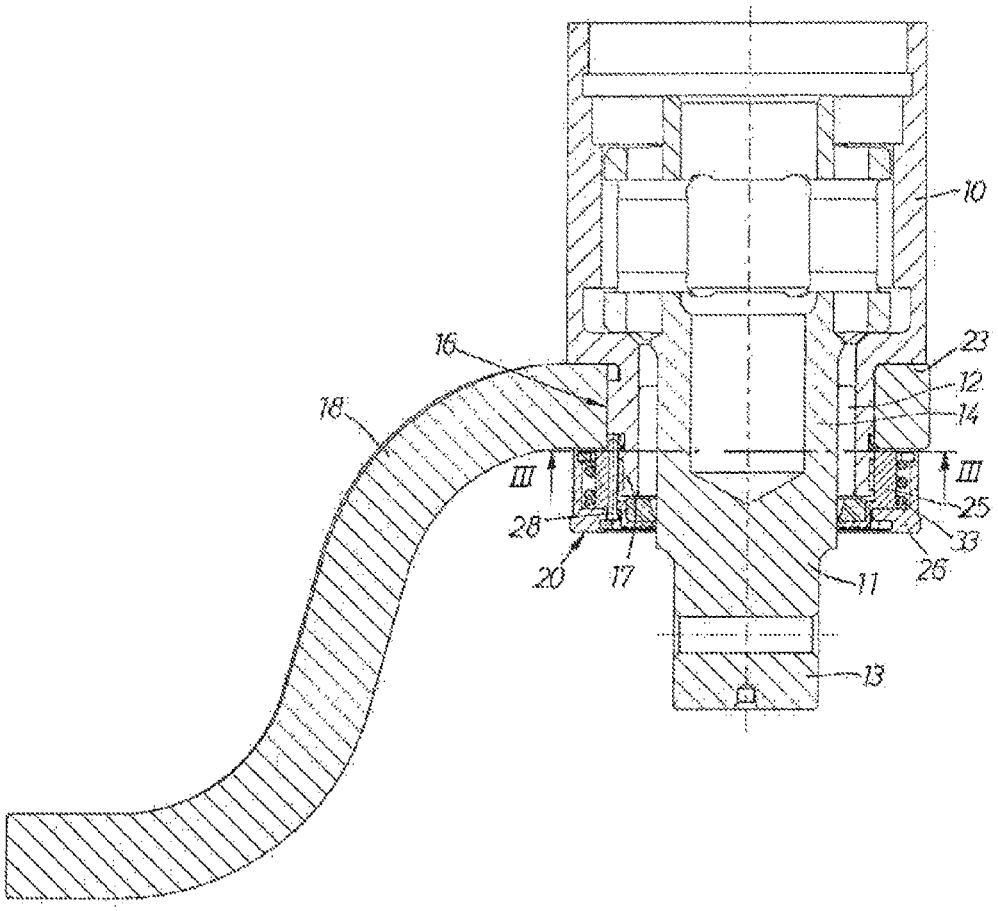
FIG. 2 shows a longitudinal section through the front end of the power wrench in FIG. 1.
Figure 3:
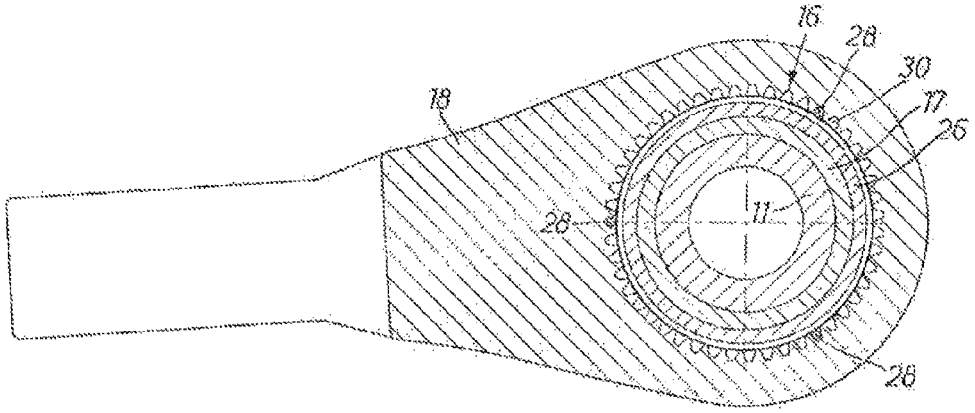
FIG. 3 shows a cross section along line III-III in FIG. 2.
Figure 4:
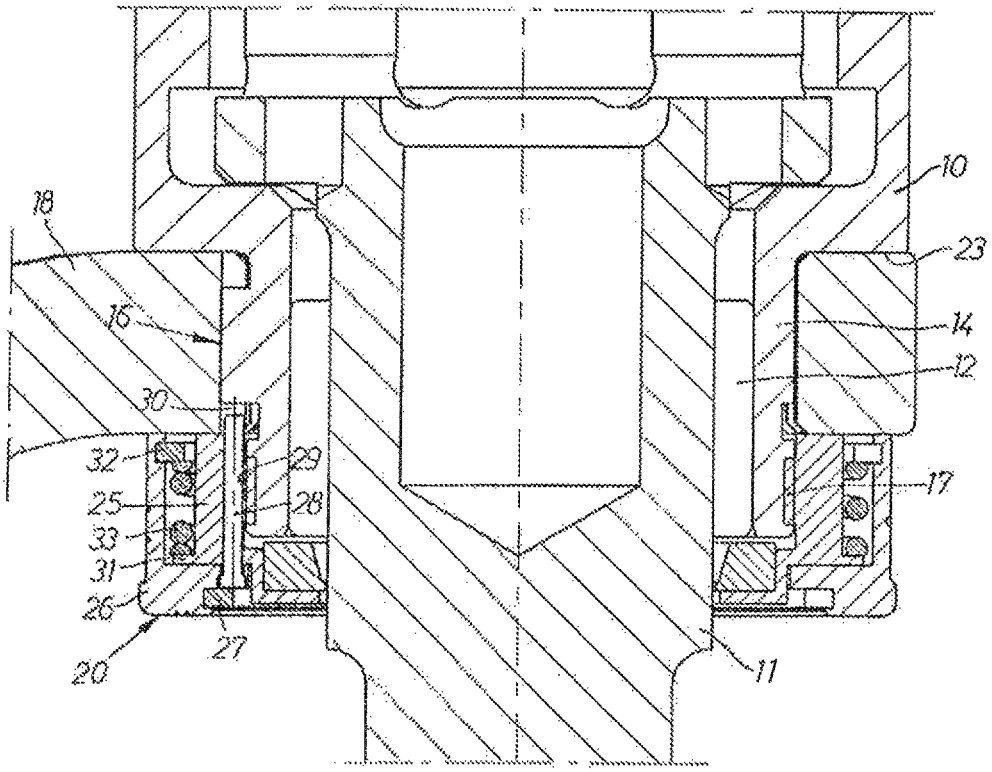
FIG. 4 shows, on a larger scale, a cross section similar to that of FIG. 2.

The power wrench comprises a housing 10 of which the front end portion only is illustrated in FIGS. 1, 2 and 4. In this front end portion there is supported an output shaft 11 journalled in a needle bearing 12. The output shaft 11 is formed with a square end 13 for connection to a screw joint to be tightened via a nut socket.

The front end portion of the housing 10 is formed with a tubular neck portion 14 having a male part of a splines coupling 16, and a threaded section 17 at its extreme end. A torque reaction bar 18 of any suitable shape is formed with a female part of the splines coupling 16 and supported on the neck portion 14 in a selectively chosen angular position suitable for an intended tightening operation to be performed.

The reaction bar 18 is maintained in its axial position relative to the housing 10 by a nut assembly 20 which engages the threaded section 17 on the outer end of the neck portion 14 so as to exert an axial clamping force on the reaction bar 18 against a shoulder 23 on the housing 10. The nut assembly 20 comprises a threaded nut element 25 for engaging the thread 22 on the neck portion 14, an outer maneuver ring 26 supported on the nut element 25. The maneuver ring 26 is axially displaceable relative to the nut element 25 between a forward lock position and a retracted release position. Three lock pins 28 are axially secured to the maneuver ring 26 by means of a lock ring 27 and extend through axially directed bores 29 in the nut element 25. This means that the lock pins 28 form a coupling means between the nut element 25 and maneuver ring 26 for transfer of rotational movement between the two parts.

In the forward lock position of the maneuver ring 26 the lock pins 28 protrude out of the inner end surface of the nut element 25. In that position the lock pins 28 are arranged to co-operate with the keyways 30 of the splines coupling 16 to lock the nut assembly 20 against rotation. Oppositely, in the rear retracted position of the maneuver ring 26 and the lock pins 28 are likewise retracted inside the nut element 25, whereby the locking engagement between the lock pins 28 and the splines coupling keyways 30 is discontinued. A spring 33 is provided between an internal shoulder 31 on the nut element 25 and a lock ring 32 secured to the maneuver ring 26 to exert a bias force on the maneuver ring 26 relative to the nut element 25 towards the lock position.

Figure 5:
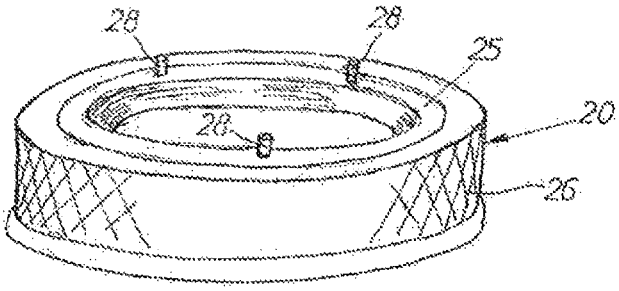
FIG. 5 illustrates in perspective view of a lock nut assembly according to the invention and being comprised in the embodiment shown in FIGS. 1-4.

In FIG. 5 the nut assembly 20 is illustrated separately and shows the three lock pins 28 protruding from the nut element 25.

Before taking the power wrench into operation, the torque reaction bar 18 is fitted to the wrench housing 10 via the splines coupling 16 in an angular position suitable for the tightening operation to be performed. To axially lock the reaction bar 18 relative to the housing 10 the nut assembly 20 is entered on the threaded section 17 of the neck portion 14 and rotated by means of the maneuver ring 26. As the nut assembly 20 has reached a position where the ends of the lock pins 28 get into contact with the reaction bar 18 the lock pins 28 have to be retracted not to interfere with the end portions of the keyways 30 of the splines coupling 16 at continued rotation of the nut assembly 20. That is accomplished by pulling back the maneuver ring 26 axially against the force of the spring 33. Now, the nut assembly 20 can be continued rotated into engagement with the reaction bar 18, and when that happens the maneuver ring 26 is freed to occupy its forward position by means of the spring 33, wherein the lock pins 28 protrude out of the nut element 25 to be received in the nearest keyways of the splines coupling 16 to thereby lock the nut assembly 20 against further rotation. Now, the reaction bar 18 is safely secured in a desired position on the housing 10.

It is to be noted that the invention is not limited to the above described example but may be freely varied within the scope of the claims. For example, the number of lock pins may be other than three.

The invention claimed is:

1. A power wrench comprising:

a housing having a forwardly extending tubular neck portion;

a motor;

an output shaft extending coaxially through the neck portion and adapted to be connected to a screw joint; and a torque reaction bar supported on the neck portion via a splines coupling including axially directed keyways for rotationally locking the torque reaction bar relative to the housing;

wherein the neck portion comprises at a forward-most part thereof a threaded section, and a nut assembly engaging said threaded section for axially clamping the torque reaction bar to the housing;

wherein said nut assembly is provided with a lock mechanism including at least one lock pin disposed in parallel with the output shaft and movable between a release position and a lock position;

wherein said at least one lock pin is arranged to positively engage with the splines coupling keyways in said lock position to thereby lock said nut assembly against rotation;

wherein said nut assembly comprises a nut element to be engaged with the threaded section, and said lock mechanism comprises a maneuver ring which is axially displaceable and rotatively locked relative to the nut element; and wherein said maneuver ring is connected to said at least one lock pin and arranged to shift via an axial displacement said at least one lock pin between said release position and said lock position.

2. The power wrench according to claim 1, wherein a spring is provided between the nut element and the maneuver ring to exert a bias force on said maneuver ring and said at least one lock pin toward said locking position.

3. The power wrench according to claim 1, wherein said at least one lock pin comprises three lock pins, which are disposed at angular intervals corresponding to a pitch of the splines coupling keyways.

4. The power wrench according to claim 2, wherein said at least one lock pin comprises three lock pins, which are disposed at angular intervals corresponding to a pitch of the splines coupling keyways.

* * * * *